US008414670B2

(12) United States Patent
Lee

(10) Patent No.: US 8,414,670 B2
(45) Date of Patent: Apr. 9, 2013

(54) DUST-SUCKING AND AIR-CLEANING COMPOSITE STRUCTURE

(76) Inventor: Wen Ching Lee, Taichung (TW)

( * ) Notice: Subject to any disclaimer, the term of this patent is extended or adjusted under 35 U.S.C. 154(b) by 0 days.

(21) Appl. No.: 13/123,377

(22) PCT Filed: Dec. 23, 2009

(86) PCT No.: PCT/CN2009/075884

§ 371 (c)(1),
(2), (4) Date: Apr. 8, 2011

(87) PCT Pub. No.: WO2010/072150

PCT Pub. Date: Jul. 1, 2010

(65) Prior Publication Data

US 2011/0192286 A1 Aug. 11, 2011

(30) Foreign Application Priority Data

Dec. 25, 2008 (CN) ..... 2008 2 0179009 U

(51) Int. Cl.
*A47L 5/38* (2006.01)

(52) U.S. Cl.
USPC ..... 55/385.1; 55/467; 55/471; 55/DIG. 3; 55/DIG. 34; 15/313; 15/314; 15/323; 15/329; 15/339; 15/344; 15/401; 15/353; 15/DIG. 1; 96/417

(58) Field of Classification Search ..... 55/385.1, 55/466, 467, 471, 472, DIG. 12, DIG. 34; 96/26, 417, 148, 423; 15/313, 314, 323, 15/328, 329, 339, 344, 401, 353, DIG. 1; 62/244, 331; 296/24.34, 24.35, 24.46
See application file for complete search history.

(56) References Cited

U.S. PATENT DOCUMENTS

| | | | | |
|---|---|---|---|---|
| 3,860,404 | A * | 1/1975 | Jochimski | 96/147 |
| 4,899,418 | A * | 2/1990 | Steiner et al. | 15/344 |
| 4,924,548 | A * | 5/1990 | Touya et al. | 15/347 |
| 4,934,020 | A * | 6/1990 | Jackson | 15/339 |
| 6,839,934 | B2 * | 1/2005 | Houghton et al. | 15/329 |
| 7,513,007 | B2 * | 4/2009 | Chernoff | 15/313 |
| 7,938,896 | B2 * | 5/2011 | Paterson et al. | 96/417 |
| 2003/0005668 | A1 | 1/2003 | Huang | |
| 2008/0006009 | A1 * | 1/2008 | Kiern et al. | 55/385.1 |

FOREIGN PATENT DOCUMENTS

| | | | |
|---|---|---|---|
| CN | 2086875 | U | 10/1991 |
| CN | 2141527 | Y | 9/1993 |
| CN | 2211568 | Y | 11/1995 |
| CN | 101098650 | A | 1/2008 |
| CN | 101277724 | A | 10/2008 |

* cited by examiner

*Primary Examiner* — Duane Smith
*Assistant Examiner* — Minh-Chau Pham
(74) *Attorney, Agent, or Firm* — Rosenberg, Klein & Lee

(57) ABSTRACT

A dust-sucking and air-cleaning composite structure is provided with a dust-sucking body and an air-cleaning body. The top surface of the air-cleaning body is provided with a vertically opening cavity. The cavity is recessed downward toward the interior of the air-cleaning body and has an opening facing upwardly. The inner profile of the cavity corresponds to the outer profile of the dust-sucking body, thereby allowing the dust-sucking body to be movably inserted into the cavity to be electrically coupled to the air-cleaning body.

8 Claims, 3 Drawing Sheets

DUST-SUCKING AND AIR-CLEANING COMPOSITE STRUCTURE

BACKGROUND OF THE INVENTION

1. Field of the Invention

The present invention relates to a dust-sucking and air-cleaning composite structure, and in particular to a dust-sucking and air-cleaning composite structure which has multiple functions.

2. Description of Prior Art

There are many indoor air pollutants such as microbes, violate organic compounds (VOC), environmental tobacco smokes (ETS), asbestos, indoor combustible objects, smokes, radioactive substances and etc. These indoor air pollutants will affect the health of a human body and may cause a headache, vomit, respiratory infection, allergy or the like. Also, dust mite is a kind of allergens. The secretion, excrement and insect body of the dust mite may cause allergic rhinitis, asthma, eye allergy, atopic dermatitis or the like. In order to eliminate the indoor air pollutants, people often clean their house by using a vacuum cleaner. Even, people uses an air cleaner to eliminate finer bacteria, ozone substances, and dust mite.

Although both the conventional vacuum cleaner and the air cleaner can be used to clean the environment, they are different from each other in terms of structure, function and storage location. Further, it takes more money to prepare the vacuum cleaner and the air cleaner at home or office, which is not economical and convenient in use.

SUMMARY OF THE INVENTION

In order to solve the above problems, an object of the present invention is to provide a dust-sucking and air-cleaning composite structure, which is economical and convenient in use. Even not in use, the present invention can be stored in one location without occupying a large space.

In order to achieve the above object, the present invention is to provide a dust-sucking and air-cleaning composite structure, which includes a dust-sucking body and an air-cleaning means. The top surface of the air-cleaning means is provided with a cavity. The cavity is recessed toward the interior of the dust-sucking body and has an opening facing upwardly. The inner profile of the cavity corresponds to the outer profile of the dust-sucking body, thereby allowing the dust-sucking body to be movably inserted into the cavity.

In comparison with prior art, the present invention has the following advantageous features. The dust-sucking body is installed in the cavity of the air-cleaning means to thereby form an integral construction. By this arrangement, the present invention is economical and convenient in use. Even not in use, the present invention can be stored without occupying a large space.

Further, the dust-sucking body is provided with a charging means. The interior of the air-cleaning means is provided with a power-supplying means. When the dust-sucking body is inserted into the air-cleaning means, the charging means is electrically connected with the power-supplying means, so that the charging means can be charged by the power-supplying means. By this arrangement, the dust-sucking means can be charged completely when in use, and thus it is unnecessary to provide an electric wire for electrically connecting to an external AC power source.

DETAILED DESCRIPTION OF THE INVENTION

In order to make the Examiner to better understand the present invention, the construction, features and embodiments of the present invention will be described in more detail with reference to the accompanying drawings.

Figure 1:
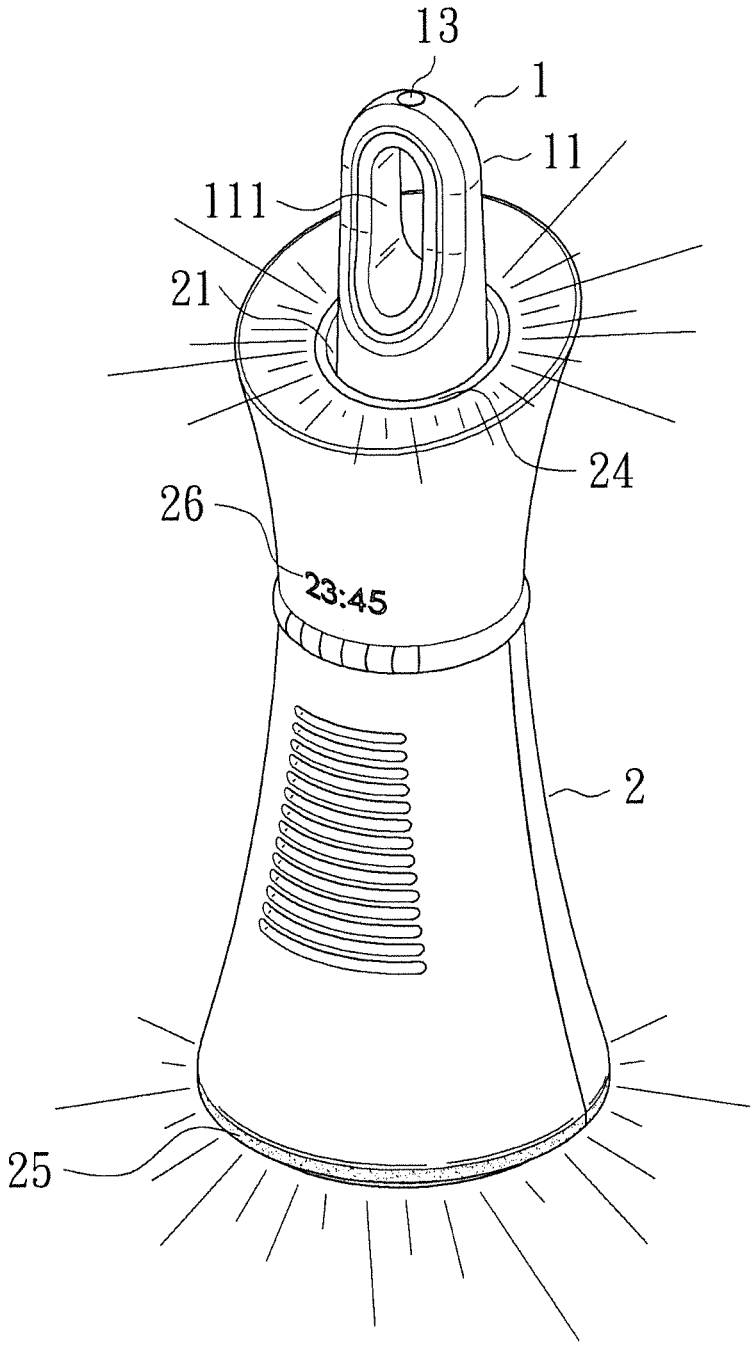
FIG. 1 is a perspective view showing that the dust-sucking body and the air-cleaning means of the present invention are assembled together.
Figure 2:
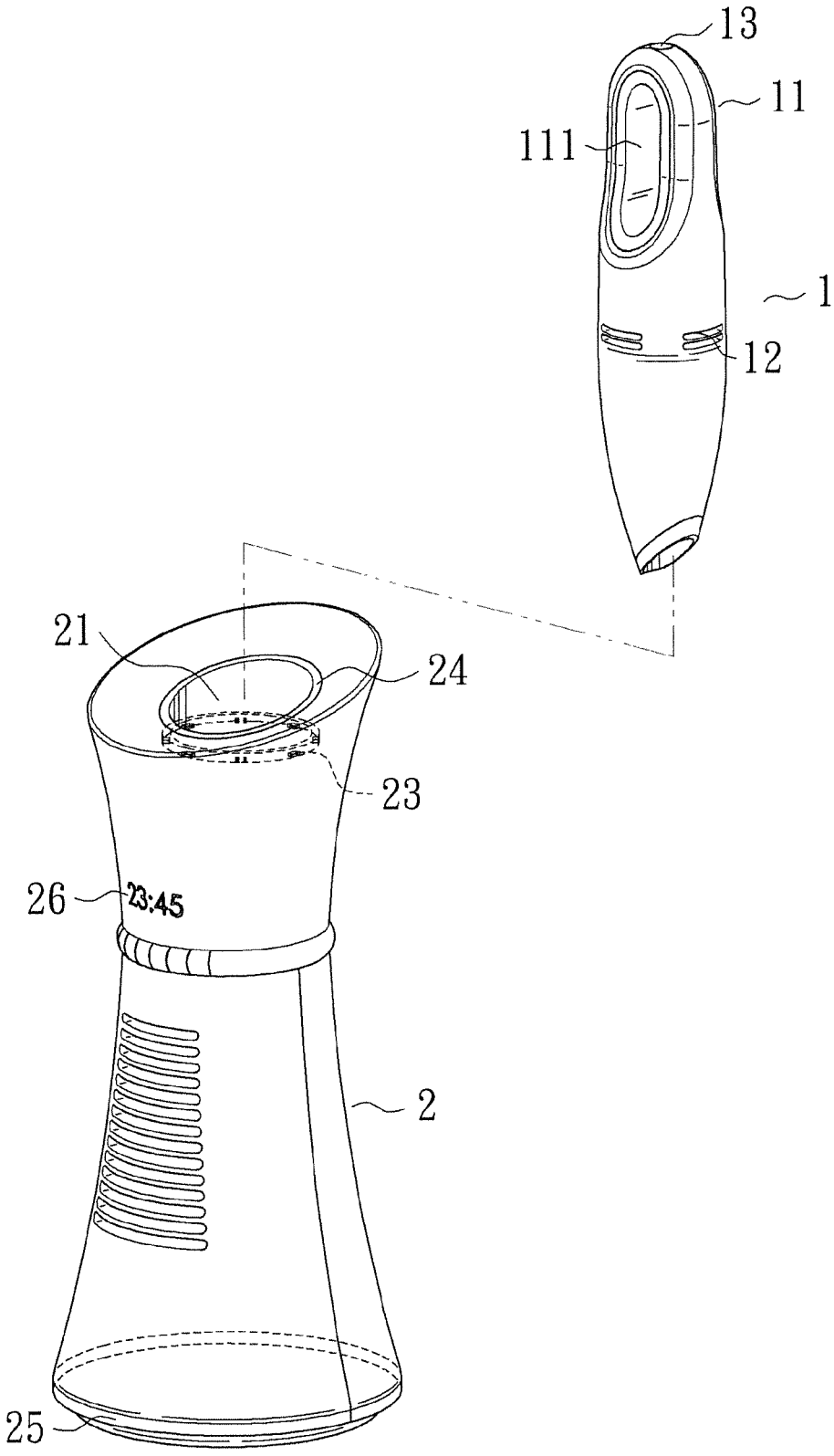
FIG. 2 is a perspective view showing that the dust-sucking body and the air-cleaning means of the present invention are separated from each other.

Please refer to FIGS. 1 and 2. The present invention is directed to a dust-sucking and air-cleaning composite structure, which includes a dust-sucking body 1 and an air-cleaning means 2.

The operating principle and internal components of the dust-sucking body 1 are not the subject matters of the present invention, so that they are not depicted in the drawings and the description thereof is omitted for simplicity. Briefly speaking, by means of the high-speed rotation of an electric motor within the dust-sucking body 1, a negative pressure is generated inside the dust-sucking body 1 to suck dust, suspended particles or waste of little mass into the dust-sucking body 1 via a suction nozzle. The dust, suspended particles or waste of little mass are filtered off in a filtering bag to thereby exhaust a cleaner air. The dust-sucking body 1 of the present invention is provided with a grip portion 11 having an annular hole 111. A user can lift up the dust-sucking body 1 by means of the annular hole 111 of the grip portion 11. The dust-sucking body 1 is provided with a charging means 12. The grip portion 11 is exposed to the outside of the cavity 21, so that the user can grip the grip portion 11 more easily. The top of the dust-sucking body 1 is provided with a switch and a power indicator 13. The switch serves to turn on/off the dust-sucking body 1, and the power indicator 13 serves to display the remaining level of electricity power.

Figure 3:
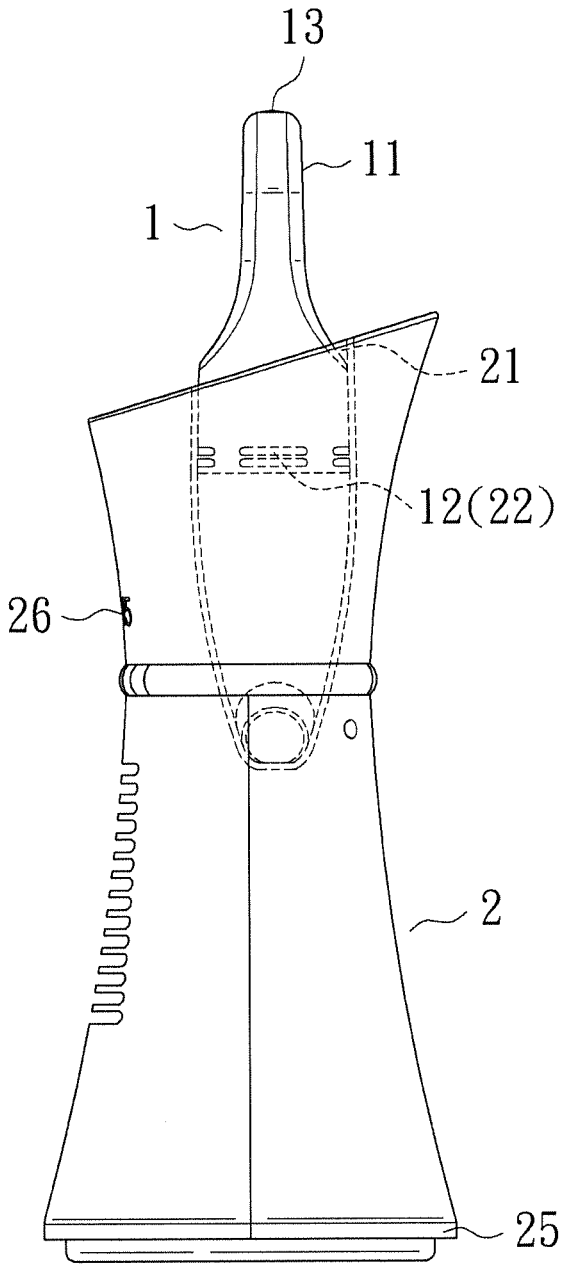
FIG. 3 is a plan view showing that the dust-sucking body and the air-cleaning means of the present invention are assembled together.

The operating principle and internal components of the air-cleaning means 2 are not the subject matters of the present invention, and they are not limited to any specific form. High-concentration negative ions or suitable amount of ozone can be used in the air-cleaning means 2 to thereby perform dust collection, sterilization and deodorization. The top of the air-cleaning means 2 is provided with a cavity 21. The cavity 21 is recessed into the air-cleaning means 2 and has an opening facing upwardly. As shown in FIG. 3, the inner profile of the cavity 21 corresponds to the outer profile of the dust-sucking body 1, so that the dust-sucking body 1 can be movably inserted into the cavity 21. The interior of the air-cleaning means 2 is provided with a power-supplying means 22. When the dust-sucking body 1 is inserted into the air-cleaning means 2, the charging means 11 is electrically connected to the power-supplying means 22, so that the charging means 11 can be charged by the power-supplying means 22.

The power-supplying means 22 is electrically connected to a charge indicator 23 for displaying the level of charge. The charge indicator 23 is provided on the inner edge of the top of the cavity 21 of the air-cleaning means 2. The charge indicator 23 serves to display whether a charging process is performing or completed. The top of the charge indicator 23 is provided with an annular portion 24. The light emitted by the charge indicator 23 passes through the annular portion 24.

The air-cleaning means 2 is also provided with a night light 25. In a preferred embodiment shown in the drawings, the night light 25 is provided on the lower edge of the air-cleaning means 2 for illuminating in the dark.

The air-cleaning means 2 is provided on its surface with a clock 26 for displaying the current local time.

According to the above, the present invention demonstrates industrial applicability, novelty and inventive steps. Further, the present invention has not been published or used in public, and thus the present invention indeed conforms to the requirements for an invention patent.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A dust-sucking and air-cleaning composite structure, comprising:

a dust-sucking body;

an air-cleaning body including:

a surface-engaging base portion supporting the air-cleaning body;

a vertically opening cavity is provided atop the air-cleaning body opposite the surface-engaging base portion, the cavity is recessed downward toward the interior of the air-cleaning body and the surface-engaging portion, the cavity has an opening facing upwardly to receive the dust-sucking body, an inner profile of the vertically opening cavity corresponds to an outer profile of the dust-sucking body, whereby the dust-sucking body is re-movably insert-able into the cavity to make an electrical coupling therebetween, whereby the dust-sucking body is charged while disposed within the vertically opening cavity, a top portion of the dust-sucking body protruding out of the vertically opening cavity; and, a charge indicator disposed proximate the vertically opening cavity atop the air-cleaning body.

2. The dust-sucking and air-cleaning composite structure according to claim 1, wherein the dust-sucking body is provided with a grip portion having an annular hole, the grip portion protrudes outside of the cavity while said dust-sucking body is inserted into said vertically opening cavity.

3. The dust-sucking and air-cleaning composite structure according to claim 1, wherein the dust-sucking body is provided with a charging module, the interior of the air-cleaning body is provided with a power-supply module, the charging module is electrically connected to the power-supplying module when the dust-sucking body is inserted into the air-cleaning body, so that the charging module can be charged by the power-supplying module.

4. The dust-sucking and air-cleaning composite structure according to claim 3, wherein the charging module is electrically connected to the charge indicator, the charge indicator is provided on an inner edge of the top of the vertically opening cavity of the air-cleaning body.

5. The dust-sucking and air-cleaning composite structure according to claim 4, wherein an annular light-guide portion is provided atop the charge indicator, wherein the light emitted by the charge indicator passes through the annular light-guide portion.

6. The dust-sucking and air-cleaning composite structure according to claim 1, wherein a night light is provided on the periphery of the air-cleaning means for illuminating in the dark.

7. The dust-sucking and air-cleaning composite structure according to claim 1, wherein a clock is provided on a surface of the air-cleaning body.

8. The dust-sucking and air-cleaning composite structure according to claim 1, wherein the portion of the dust-sucking body protruding out of the vertically opening cavity is provided with a switch and a power indicator, the power indicator displays a remaining level of electricity power.

* * * * *